United States Patent [19]

Oakes

[11] 3,958,855

[45] May 25, 1976

[54] ELECTRICAL CONNECTOR

[75] Inventor: Lloyd Oakes, Kinston, N.C.

[73] Assignee: Joy Manufacturing Company, Pittsburgh, Pa.

[22] Filed: Mar. 7, 1975

[21] Appl. No.: 556,106

Related U.S. Application Data

[63] Continuation-in-part of Ser. No. 409,901, Oct. 26, 1973, abandoned, which is a continuation of Ser. No. 215,729, Jan. 6, 1972, abandoned.

[52] U.S. Cl. ..... 339/111; 200/144 C; 339/12 G

[51] Int. Cl.[2] ..... H01R 13/52

[58] Field of Search ..... 339/111, 12, 45, 75 R; 200/148 A, 144 C, 149 A

[56] References Cited

UNITED STATES PATENTS

| | | | |
|---|---|---|---|
| 2,809,360 | 10/1957 | Cobbett | 339/111 |
| 3,542,986 | 11/1970 | Kotski | 200/148 A X |

*Primary Examiner*—Roy Lake
*Assistant Examiner*—DeWalden W. Jones
*Attorney, Agent, or Firm*—Richard J. Sher

[57] ABSTRACT

An electrical termination for use with a high voltage underground cable system wherein a large degree of arcing may occur between two electrical structures as they are brought together under short circuit conditions to complete a live high voltage circuit. Gas generating material is included as part of at least one of the structures such that gas is produced by the arcing between the structures as they are moved towards each other to form the desired electrical connection. The pressure build up of the gas within the termination acts upon a movable gas actuated means to cause movement thereof when the structures are brought close together under fault conditions. When moved by such a pressure build up, a portion of the gas actuated means transfers the arcing to a position away from the gas generating material to cause the cessation of gas production and thus permits the structures to couple and complete the circuit.

21 Claims, 9 Drawing Figures

ELECTRICAL CONNECTOR

RELATED APPLICATIONS

This application is a continuation-in-part of U.S. Pat. application Ser. No. 409,901 filed Oct. 26, 1973 which is a continuation of U.S. Pat. application Ser. No. 215,729 filed Jan. 6, 1972, now abandoned.

Increased utilization of underground high voltage electrical systems has resulted in an increased demand for new and improved high voltage connectors. One of such high voltage electrical connectors utilizes a termination having a gas producing material therein which aids in deionizing the air across the arc length during load break of the terminations. The deionized air has a high dielectric strength which results in the arc being extinguished by prevented restriking of the arc once the alternating current goes through current zero. Such connectors have been found to be quite adequate for normal make and break situations; however, it has been found that serious problems develop with such connectors during the making of a connection under fault conditions. Under fault the amount of gas generated by the fault current is excessive and will result in rupture of the connector unless precautions are taken to quickly stop the gas generation.

By use of the present invention, which includes a gas actuated means movable upon fault closure by gas pressure build up within the connector so that a portion of the gas actuated means transfers the arcing away from the gas producing material within the connector, the hereinabove mentioned problem of fault coupling is greatly alleviated, for such change in the position of the arcing simultaneously results in the cessation of gas production.

These and other objects and advantages of the present invention will become more readily apparent from the following detailed description and drawings in which.

Figure 6:
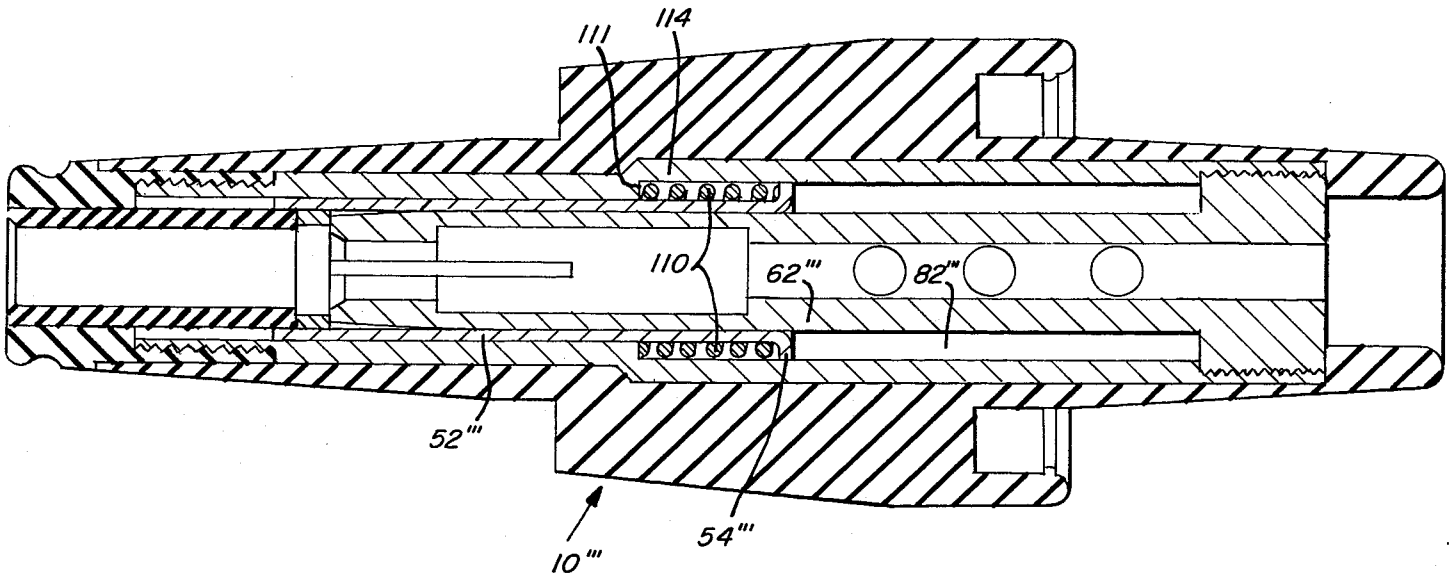
FIG. 6 is a longitudinal sectional view of still another alternative embodiment of the invention.
Figure 8:
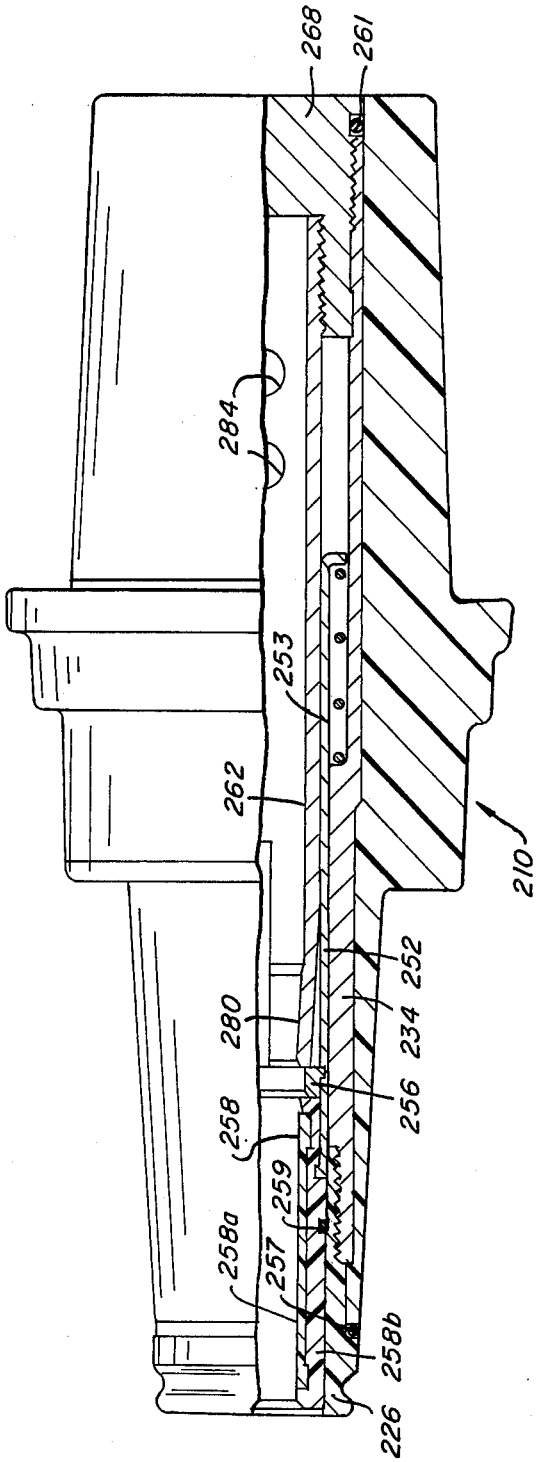

FIG. *7a* is a partial side elevational view of an alternative embodiment of the gas actuated means or shunt assembly of FIG. 6;

FIG. *7b* is a rear elevational view of the alternative shunt assembly of FIG. *7a;* and FIG. 8 is a partial, longitudinal sectional view of another preferred embodiment of the invention.

Figure 1:
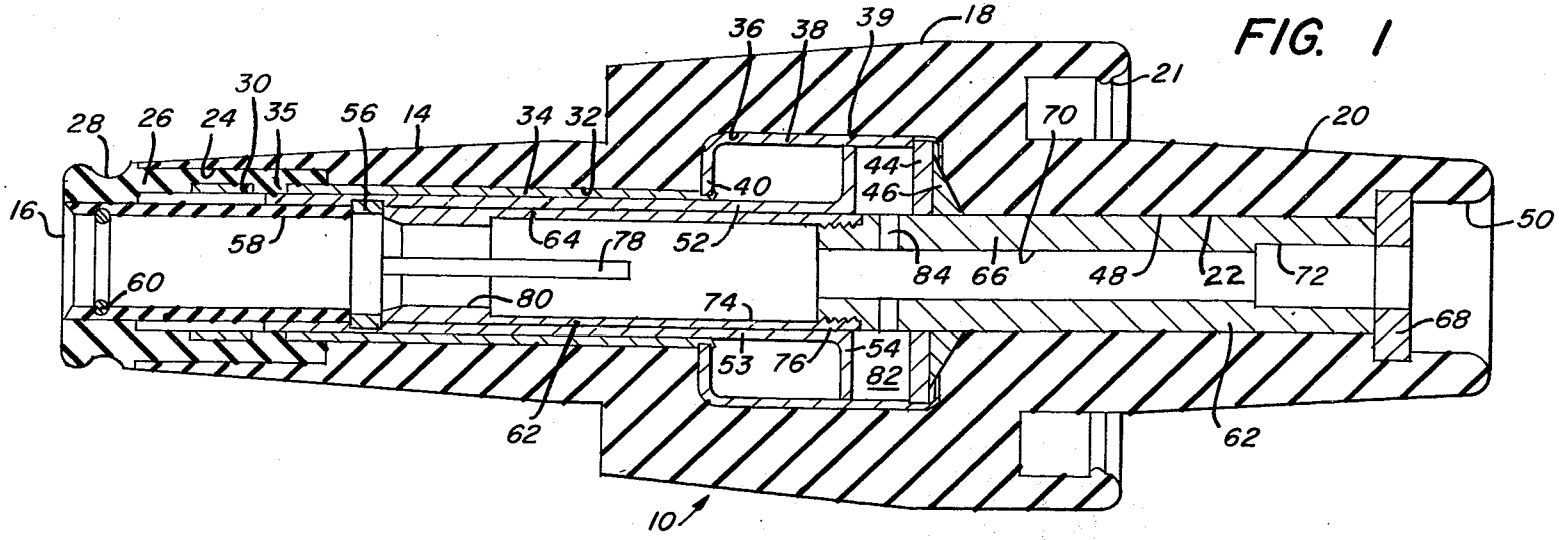
FIG. 1 is a longitudinal sectional view of one termination of an electrical conductor constructed in accordance with the principles of the invention with the gas actuating means thereof shown in a normal-closing position.

Referring to FIG. 1 there is shown an electrical termination of an electrical conductor in the form of a female bushing generally indicated at 10 constructed in accordance with the principles of the present invention and which is adapted to be mated with another termination or male elbow 12 (FIG. 3) in a normal circuit connecting manner described hereinafter.

As shown, the bushing 10 comprises a plurality of coaxial, axially abutting, integrally formed elastomeric sections which include: a forward or elbow-bushing interface portion 14; a rear or bushing-well interface portion 20; and an intermediate body portion 18 disposed axially intermediate portions 14 and 20. The outer diameter of portion 18 is shown as being of a greater diameter than portions 14 and 20. Portions 14 and 20 have a generally frusto conical configuration with respective smaller diameter portions thereof being at the respective free ends thereof.

Portion 18 includes an annular lip portion 21 adjacent the rearward end thereof having the inner periphery thereof overlying and spaced from the outer periphery of the forward end section of portion 20. In an assembled position portion 20 is received within the well of a high voltage transformer connection (not shown) in a well known manner and lip portion 21 is adapted to cooperate with the transformer connection to maintain a secure moisture proof junction.

A bore 22 having a plurality of bore sections extends through bushing 10 and is coaxial therewith. The forwardmost end of bore 22 at the plug receiving end of portion 14 has a receiving bore section 24 of a suitable diameter to receive an annular reinforcing nose bushing 26 of hardened non-conductive material. The nose bushing 26 is firmly secured to the inside face of the bore section 24 such as by bonding. A locking groove 28 encircles the forwardmost outer end portion of nose bushing 26 in a manner to retain the plug termination 12 (FIG. 3) in a mating position as explained hereinafter. Coaxially and snugly received within the inner periphery 30 of nose bushing 26 and extending rearwardly therefrom into a bore section 32 which extends through portion 14 is an annular guide cylinder 34 which is of conductive material such as steel or aluminum. The outside diameter of the guide cylinder 34 is the same as the inside diameter of the inner periphery 30 of nose bushing 26 and is coaxially aligned therewith. The guide cylinder 34 is firmly positioned in any suitable manner, for example by bonding to serrations 35 on the inside face 30 of nose bushing 26 and the inside of the portion 14 within the bore section 32 or by premolding or similar means. Adjacent the bore section 32 in the body portion 18 is an enlarged bore section 36 which houses a cylinder assembly 38. The cylinder assembly 38 is constructed of a conductive material which is bonded to the bore section 36 which is of a larger diameter than the bore section 32. Cylinder assembly 38 includes a cylinder portion 39 shown as having an outer diameter thereof substantially equal to the diameter of bore section 36 and forward and rear wall sections 40 and 44 adjacent the respective axial ends of cylinder 39. Wall sections 40 and 44 include coaxially aligned bores therethrough which are also coaxial with the inner periphery of guide cylinder 34. The rear wall 44 is reinforced by annular member 46 and is adjacent an extension bore section 48 which openly communicates between bore section 36 and a rearwardmost bore section 50.

Coaxially and slidably positioned within the guide cylinder 34 is a gas actuated means or shunt assembly 52. Assembly 52 comprises: an elongated tubular portion 53; an annular radially outwardly extending flange or piston portion 54 adjacent the rearward end of portion 53; an annular shunt or arcing ring or arc bushing 56 carried by portion 53 intermediate the axial ends thereof and internally thereof; and an annular snuffer bushing 58 which may abut shunt ring 56 and extends outwardly therefrom having the forwardmost end thereof forwardly spaced from the forwardmost end of portion 53. Shunt ring 56, tubular portion 53; and piston portion 54 are of a suitable conductive material such as aluminum while bushing 58 is of a non-conductive, preferably arc-responsive gas producing material. As illustrated, portion 53 slidably engages the inner periphery of guide tube 34, and the outermost periphery of piston portion 54 slidably engages cylinder 39. As shown, an elastomeric O-ring seal 60 is secured within the snuffer bushing 58 adjacent the forward end thereof to form a seal with the male contact of a plug section 12 as described hereinafter.

A stationary electrically conducting female contact 62 is carried within bushing 10. The contact 62 may be of one piece; however, for simplicity of assembly is shown as a forward contact receiving section 64 secured to a rear anchor section 66. The anchor section 66 is to be inserted into a well of a transformer interface (not shown) and is shown herein in FIG. 1 as being secured by molding within the walls of bore section 48 and further secured therein by a conductive retainer ring 68 in the bore opening 50. The anchor section has an axial bore 70 therethrough, a portion of which 72 is adapted to receive a conductor from the well of a transformer interface when the entire bushing 10 is mounted in a normal transformer assembly. A bore 74 in the contact receiving section 64 is suitably threaded within the rearward end 76 and is secured to the anchor section 66 to complete the contact 62. The outside diameter of the contact receiving section 64 and the inside diameter of cylinder 34 are such that the shunt assembly 52 is slidably guided between the contact receiving section 64 and the guide cylinder 34 while maintaining electrical communication therebetween. The guide cylinder 34 is electrically connected to contact 62 through wall section 40, cylinder 39, and wall section 44; all of these elements making up a fixed electrical structure. A plurality of circumferentially spaced longitudinally extending slots 78 (only one of which is shown in FIG. 1) are located in the forward end portion of the contact receiving section 64 and define therebetween radially inwardly biased fingers (shown in the radially outwardly expanded position) forming a main interior contact receiving surface 80 of female contact 62 and producing a cantilever spring effect to insure a secure engagement with the male contact assembly 88 (FIG. 3) when inserted therein. The bore 74 of the contact receiving section 64 is in communication with the bore 70 of the anchor section 66 and also in communication with a piston chamber 80 within the cylinder assembly 38 by means of a plurality of passageways 84 in the anchor section 66. Passageways 84 extend radially through the section 66 and the radially outermost ends thereof communicate with chamber 82 adjacent the rearward end thereof. Chamber 82 is of a variable volume being defined at the radial inner and outer peripheries thereof by respective peripheral portions of contact 62 and cylinder 39 and at the respective axial ends thereof by piston portion 54 and rear wall 44. Introduction of pressurized gas through passageways 84 to the piston chamber 82 will affect the positioning of the shunt assembly 52 as shown in FIG. 2 and as described hereinafter.

Figure 3:
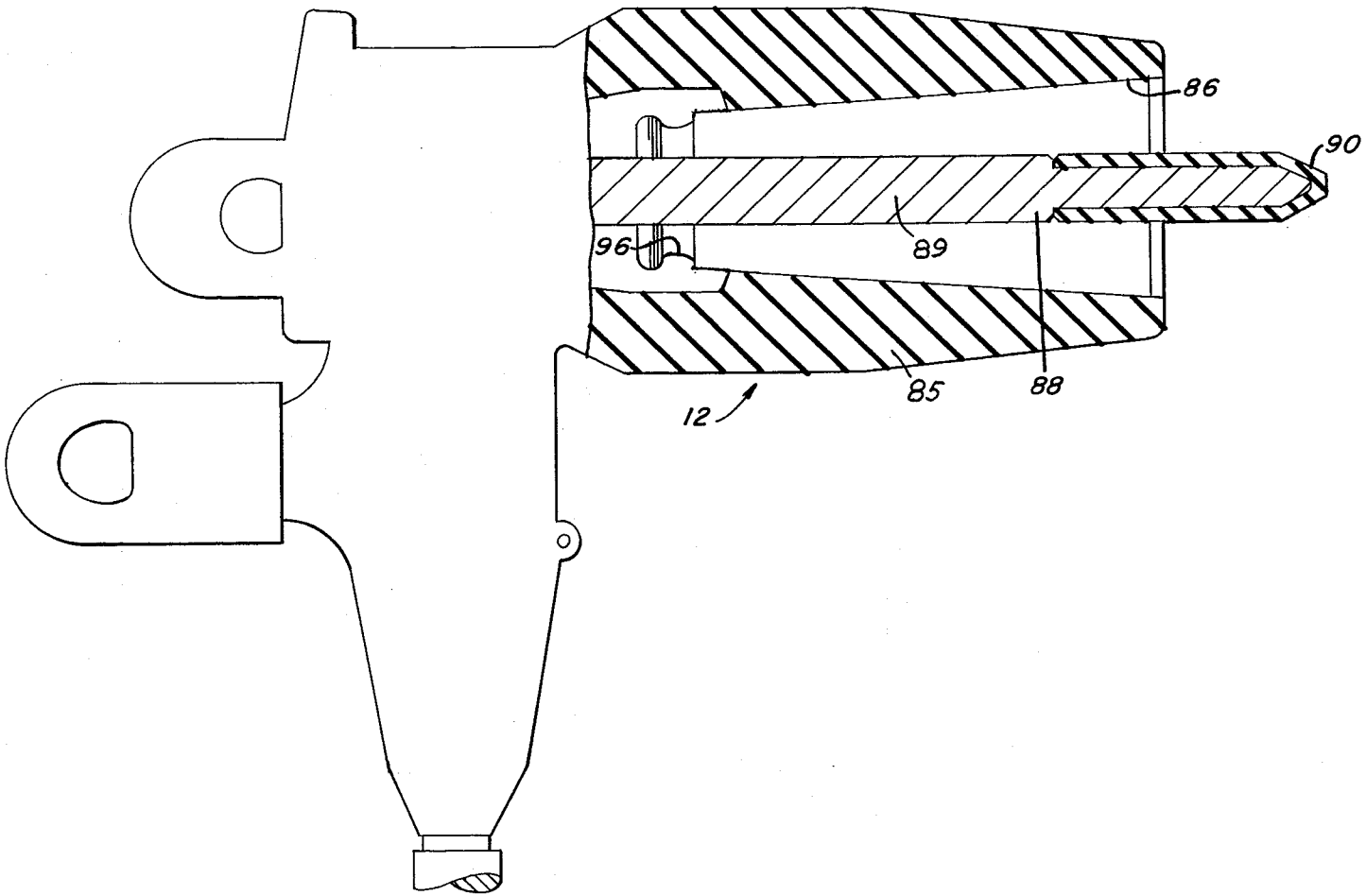
FIG. 3 is an illustration, partly in section, of another termination of an electrical cable adapted to couple with the termination illustrated in FIGS. 1 and 2.

The male termination 12 as shown in FIG. 3 is of a usual well known construction having a molded elastomeric body 85 which includes a molded internal interface portion 86 which is adapted to snugly and sealingly receive portion 14 of bushing 10 therewithin. Termination 12 additionally includes a male contact assembly 88 extending therewithin coaxially with bore 86 with the outer or free end of contact assembly 88 being spaced forwardly from the forwardmost end of body 85. Assembly 88 comprises a rear male contact portion 89 of suitable conductive material and a forward guiding and gas producing portion 90 which is suitably secured to the exterior of the forwardmost end of portion 89. Portion 90 is made of a suitable insulating material which emits an arc quenching gas when an electrical arc extends over a peripheral portion thereof as is well known in the art. A suitable material for portion 90 is an acetal material such as that produced under the trademark DELRIN. Inasmuch as male termination 12 is of a type generally well known in the art only a brief description thereof is deemed necessary.

Figure 2:
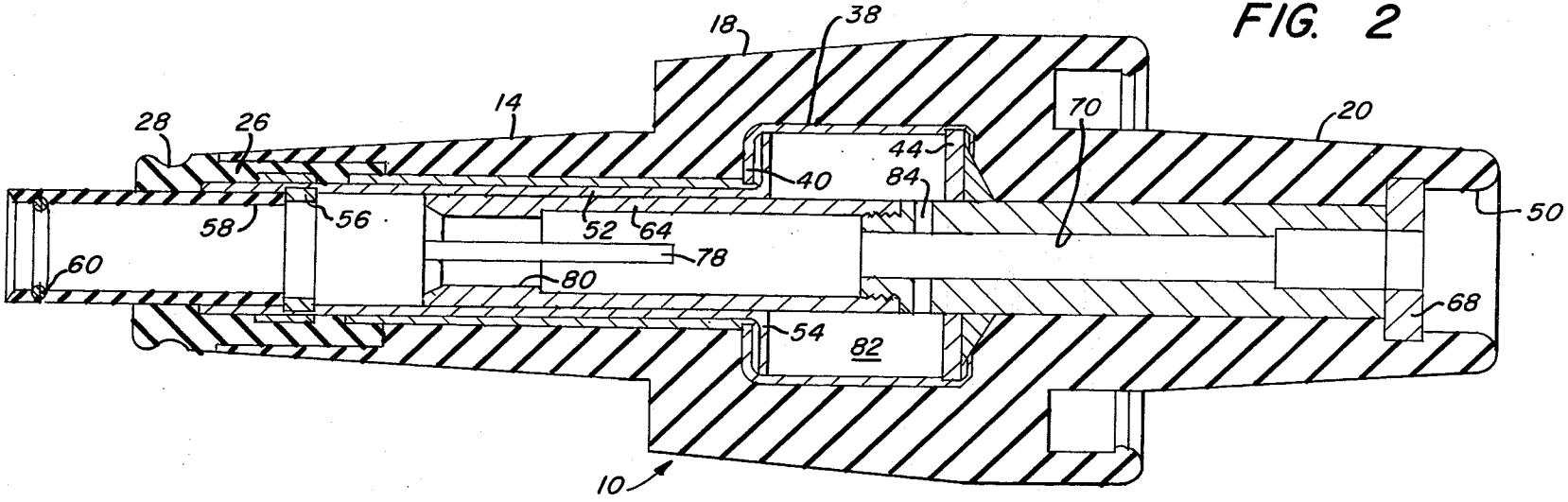
FIG. 2 is a longitudinal sectional view of the termination illustrated in FIG. 1 with the gas actuating means thereof shown in a fault-closing position.

In connecting the male termination 12 to the female termination 10 under load conditions to form an electrical connection, the male termination 12 will be advanced towards the stationary female bushing 10 at a suitable coupling velocity, for example 40 to 80 inches per second, and the male contact assembly 88 will be received within the snuffer portion 58 which, due to a previous uncoupling operation, may be in the extended or uncocked position illustrated in FIG. 2. As portion 90 of assembly 88 is moved into bushing 58 it frictionally and sealingly engages the O-ring seal 60 and by continued coupling movement of portion 90 the shunt assembly 52 will be moved rearwardly with respect to female termination 10 to the unextended or cocked position as illustrated in FIG. 1. As the male contact portion 89 approaches the female contact 62 arcing occurs between portion 89 and the arcing ring 56 which is in electrical engagement with contact 62 yet closer to portion 89 being located forwardly thereof. The arcing occurs prior to mechanical contact being established between male contact portion 89 and female contact 62. During this initial stage the arcing between portion 89 and arc ring 56 passes over the gas producing portion 90 of the male contact assembly 88 thereby producing a gas which is emitted by portion 90. Under normal non-fault making conditions the current, for example 200 amps, is not sufficient to produce any large quantities of gas, therefore, the gas pressure build up within the female bushing 10 is not sufficient to appreciably oppose the coupling of bushing 10 and elbow 12 nor is the pressure build up sufficient to move the shunt assembly 52. Accordingly, under non-fault closing the coupling of elbow 12 to bushing 10 continues substantially unabated until contact is established between bushing 10 and elbow 12; such contact being established by the mechanical engagement between the male contact portion 89 and the female contact 62. It is to be noted that the inner diameter of snuffer bushing 58 is less than the inner diameter of arcing ring 56, for example a 0.007 inch radial clearance exists between adjacent peripheries thereof. Accordingly, contact is not established between ring 56 and male contact portion 89 for whenever current is carried across the gap between the peripheries it is by an arc extending therebetween, and it is well known that striking an arc between two elements does not establish contact.

When coupling bushing 10 and elbow 12 under fault conditions the arc struck between the male contact portion 89 and the arc ring 56 carries a very large current, for example 2,000 to 10,000 amps, thus producing a large quantity of gas from portion 90. If the cessation of gas production does not occur substantially simultaneously after the arc is struck the female bushing 10 may rupture and/or a gas pressure may develop which would greatly inhibit the coupling of bushing 10 and elbow 12. According to the present invention, under such fault coupling conditions the gas produced will flow through bore 74 in section 64 and through passageways 84 to chamber 82. Gas will also flow through slots 78 and due to the inherent spaces in a normal sliding fit it will flow inwardly between contact 64 and tubular portion 53 of shunt assembly 52 into chamber 82 making it possible to eliminate passageways 84 if desired. The sealing engagement between male assembly 88 and O-ring 60 will aid in increasing the gas pressure within bushing 10 and the pressure will immediately be built up within chamber 82 which reacts on piston portion 54 of shunt assembly 52 to rapidly move shunt assembly 52 forwardly to the "uncocked" position illustrated in FIG. 2. Such movement results in arcing ring 56 surrounding and being radially spaced from an adjacent portion of male contact portion 89 and arcing therebetween directly across the radial gap. The arc length is hence reduced from the prestrike arc length of, for example, between 0.25 and 0.3 inches to the arc length between the adjacent portions of portion 89 and ring 56 of, for example, approximately 0.007 to 0.017 inches. It has been found that, for example, a male contact of 0.500 (+0.002 or −0.003) inch outside diameter, a snuffer bushing of 0.510 (+0.002 or −0.003) inch inside diameter and an arcing ring of 0.530 (+0.002 or −0.003) inch inside diameter produce a combination suitable to perform the objects of the invention. It is noted that the male contact portion 89 will be substantially coaxially aligned within the respective inner peripheries of the snuffer bushing 58 and arcing ring 56 by means of the forward portion 90 of male contact assembly 88 being in substantially coaxial engagement with female contact 62. Also, since the inside diameter of the arcing ring 56 is greater than the inside diameter of the snuffer bushing 58 physical contact between the male contact portion 89 and the arcing ring 56 is impossible. After the movement of shunt assembly 52 to the uncocked position the arcing no longer extends across the gas producing portion 90 or snuffer bushing 58 and hence gas production immediately ceases. The movement of the male termination 12 to the final position is continued until the contact between elbow 12 and bushing 10 is established by mechanical engagement between male contact 89 and female contact 62. It is to be noted that substantially all arcing between male contact portion 89 and female contact 62 is prevented due to the presence of the arcing ring 52 therebetween; however, just before mechanical contact is made between portion 89 and contact 62 some slight arcing may occur. It is further to be noted that the movement of the shunt assembly 52 into the uncocked position establishes electrical cooperation between male portion 89 and female contact 62 by having the current flow from portion 89 to arc ring 56 by means of an arc extending therebetween and either directly down the tubular portion 53 of shunt assembly 52 to the stationary female contact 62 or from the arcing ring 56 to tubular portion 53 to guide cylinder 34 to cylinder assembly 38 to contact 62, or both paths. In this respect it can readily be seen that various elements discussed hereinabove as being constructed of conductive material can be constructed of non-conductive material as long as at least one adequate electrical path is provided between arcing ring 56 and female contact 62.

The coupling of male termination and female bushing 10 is completed when end 16 of bushing 10 abuts the inner end of the chamber 86 where an internal lip 96 locks in place with the cooperating external locking groove 28 adjacent the forward end of female bushing 10 to maintain the connector together in a secure watertight fashion.

In opening a connector assembly utilizing a female bushing 10 as illustrated in FIGS. 1 and 2 the male termination 12 is moved away from the coupling relationship with bushing 10. When such movement results in disengaging the contact between male contact 89 and female contact 62 an arc will be struck. The arc struck will go through current zero once each one-half cycle or once each ½ inch of movement assuming a breaking velocity of 60 inches per second. The arc may continue to restrike each half-cycle even after complete withdrawal unless the arc is prevented from restriking. The arc will extend over the portions 90 and 58 which results in the production of gas which deionizes the air across the arc length. The deionized air having a high dielectric strength prevents voltage breakdown thereacross, thereby quenching the arc by preventing its being restruck. Also, by virtue of O-ring seal 60 sealingly engaging male contact assembly 88 of elbow 12, the hot gases are substantially trapped within the bushing 10 alleviating the possibility of an arc being struck between one of the contacts and a grounded connection. It is obvious that an O-ring may be permanently positioned around the male contact assembly 88 of male termination 12 (FIG. 3) in order to accomplish the same result.

It should be pointed out that the above description assumes alternating current of 60 cycles per second which will produce arcing i.e., two distinct arcs per second, rather than a continuous arc as would be the case in a direct current system. The invention described herein, however, has equal utility in a direct current system, therefore, the term "arc" and "arcing" are used interchangeably throughout the specification.

FIGS. 4, 5, 6, 7 and 8 illustrate alternative component embodiments which may be utilized in practicing the principles of the present invention.

Figure 4:
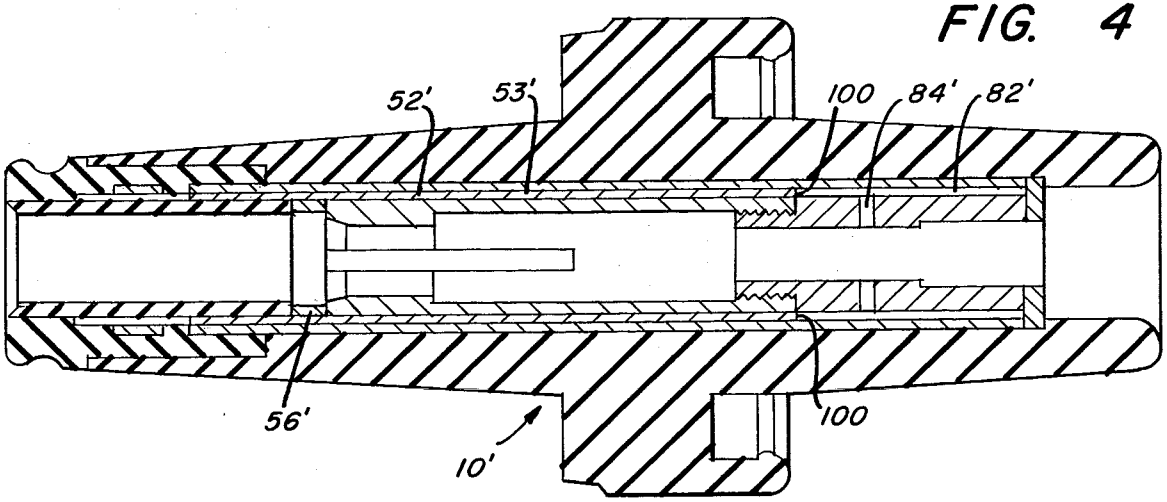
FIG. 4 is a longitudinal sectional view of an alternative embodiment of the invention.

The embodiment illustrated in FIG. 4 differs from the FIG. 1 embodiment primarily by the modification of the shunt assembly 52, the modification of cylinder assembly 38, and the elimination of O-ring 60. Shunt assembly 52' of female bushing 10' comprises an elongated tubular portion 53' carrying a shunt ring 56' adjacent the forward end thereof. The annular rear end surface 100 of portion 53' takes the place of piston flange 54 of the bushing of FIG. 1 being the surface on which the pressurized gas is operative to move shunt assembly 52'.

Figure 5:
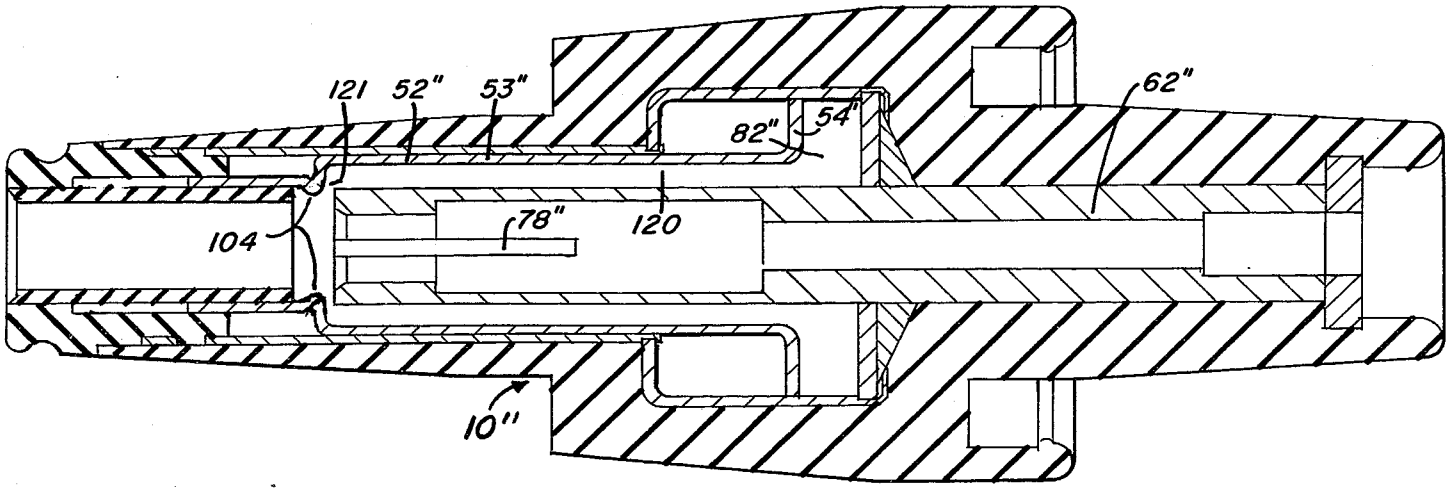
FIG. 5 is a longitudinal sectional view of another alternative embodiment of the invention.

The embodiment illustrated in FIG. 5 also shows a modified shunt assembly. Shunt assembly 52'' of bushing 10'' replaces the arcing or shunt ring 56 by a radially inwardly extending crimped portion 104 integral with and adjacent the forward end of tubular portion 53''; however, the same peripheral clearance will obviously be maintained between portion 104 and male portion 90 as was maintained between shunt ring 56 and portion 89. Also, passages 84 have been eliminated. In this embodiment pressurized gas is allowed to flow either through passage 121 or slots 78'' into passageway 120 and thence into variable volume chamber 82'' where the gas acts on surface 54'' to move shunt assembly 52'' substantially in the same manner as hereinbefore described with reference to FIGS. 1 and 2.

The embodiment illustrated in FIG. 6 incorporates guide cylinder 34 and cylinder assembly 38 of female bushing 10 into an elongated unitary guide cylinder 114 having a stepped cylindrical annular configuration which in conjunction with the stationary female contact 62''' forms a relatively long narrow annular chamber 82''' in which gas is effective on a reduced diameter piston section 54''' of shunt assembly 52'''. Female bushing 10''' additionally includes a biasing spring 110 positioned axially intermediate the forward end of shunt assembly 52''' and the internal stepped flange 111 located at the change in diameter of the guide cylinder 114. The spring 110 is operative to return the shunt assembly 52''' to the "cocked" position after assembly 52''' has been moved to the "uncocked" position during the above described fault closing operation and also to prevent movement of the shunt assembly 52''' when such movement is not required during normal non-fault closing and during opening. It should be noted that in operation of the embodiment of FIG. 6 the shunt assembly 52''' may possibly move forward and back a number of times during the fault closing movement of the male termination 12 due to the fact that when the shunt assembly moves to its forward position gas will cease to be produced and the spring 110 will then force shunt assembly 52''' back to its normal position and an arc may again be struck causing gas to again be produced and move the shunt assembly forward.

Figure 7B:
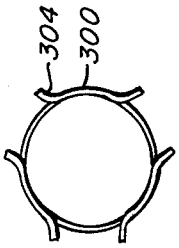
Figure 7A:
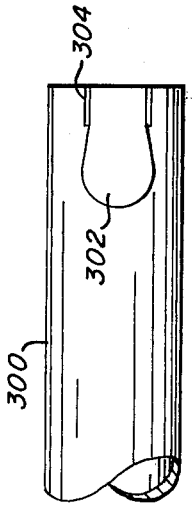

FIGS. 7*a* and 7*b* show an alternative configuration of the tubular portion 53 of shunt assembly 52. The alternative embodiment is comprised of a tubular body portion 300 with a plurality of slots 302 circumferentially spaced therearound at the rear end thereof. Radially outwardly extending flanges or tabs 304 are formed at the sides of slots 302 to engage the spring 110 of FIG. 6. It can be seen that by using such a configuration as shown in FIGS. 7*a* and 7*b* the piston 54''' of FIG. 6 has been eliminated. It has been found that sufficient gas pressure is generated under fault conditions so that only the small surface on the rear side of the arc ring 56 (FIG. 1) need be exposed to the gas in order that the shunt assembly 52 be caused to move forward against the force of spring 110. When using the pistonless assembly suggested by FIGS. 7*a* and 7*b* it can be seen that passages 84 (FIG. 1) are not needed and may be eliminated.

FIG. 8 depicts a number of other component modifications which may be utilized in a termination according to the present invention. The female bushing 210 of FIG. 8 is similar to the female bushing 10''' of FIG. 6. However, in the female bushing 210 the nose bushing 226 is externally threaded and threadingly engages the guide cylinder 234. This configuration allows the nose bushing 226 to present a smooth internal surface which joins to form a continuous surface with guide cylinder 234. The snuffer bushing 258 is comprised of two sections 258*a* and 258*b*. Internal section 258*a* is of a well known arc-responsive, gas producing material while outer section 258*b* is of a mechanically stronger and less expensive insulating material. This two-section structure improves the durability of the snuffer bushing while reducing the cost of manufacture. As shown, the integrity of the gas actuated means 252, comprised of tubular portion 253, arc ring 256 and snuffer bushing sections 258*a* and 258*b*, is at least partially maintained by means of interlocking annular flanges on the respective portions thereof. In order to further insure that high pressure gases generated within the bushing 210 do not escape for the reason set forth hereinbefore with reference to the description of O-ring 60 of FIG. 1, additional O-rings may be incorporated into the assembly as shown in FIG. 8. O-ring 257 positioned between nose bushing 226 and the insulating body of female bushing 210 helps prevent the escape of gases through the threaded connection of nose bushing 226 and guide cylinder 234. At the rearward end of bushing 210 O-ring 261 likewise prevents escape of gases through the threaded connection of guide cylinder 234 and end piece 268. It is noted that both O-rings 257 and 261 may be eliminated and replaced by conventional pipe thread sealing tape or compound placed within the threads of the threaded connections. Another O-ring 259 is placed within an annular groove on the outer surface of snuffer bushing 258. O-ring 259 assures both sliding and sealing contact between snuffer bushing 258 and the smooth interior surface of nose bushing 226.

It is pointed out that it is possible to utilize any combination of the alternative component embodiments described in FIGS. 1–8. For example the two section snuffer bushing of FIG. 8 may be utilized with the pistonless tubular portion 53' of FIG. 4 and the female contact 262 of FIG. 8 may be formed without passages 284 as shown in FIG. 5 in which case gas may flow between female contact 262 and 253 as explained hereinbefore with reference to FIG. 1.

Various modifications can be made to the invention as described hereinabove without departing from the spirit and scope thereof, for example: although the description has previously focused on an electrical bushing and elbow connector the invention may be practiced with any electrical termination; variations in sizes and shapes of piston faces, piston chambers, arc bushings, and the like may be effected. Accordingly, the scope of the present invention is to be interpreted only in accordance with the scope of the claims as set forth hereinafter.

What is claimed is:

1. An electrical connector device comprising: an insulating housing means; an elongated first contact means located within said housing and having a contact receiving section at one end thereof accessible through a contact receiving opening in said housing means; an elongated second contact means having at least the external surface of a free end portion thereof of a material which produces a gas when subjected to an electrical arc and an electrically conducting portion axially adjacent said free end portion, said portions of said second contact means being insertable into said contact receiving opening upon relative coaxial movement of said first and second contact means towards each other, electrical shunt means located within said housing means comprising an elongated member axially slidable with respect to said first contact means and having a first segment in gaseous communication with said contact receiving section and a second segment adjacent said one end of said first contact means; said second segment being movable to a location axially outwardly of said one end of said first contact means and being in electrical communication with said first contact means in all relative positions thereof; and said second segment having a configuration to establish non-contacting electrical communication with said electrically conducting portion at said axially outward position.

2. An electrical connector device as specified in claim 1 further characterized in that said first contact means is secured within said housing in a stationary manner.

3. An electrical connector device as specified in claim 1 further characterized in that said first contact means has a cantilever spring biased portion securely engaging said second contact means when said second contact means is received in said contact receiving section.

4. An electrical connector device as specified in claim 1 wherein said first contact means is adapted to be rigidly secured to one end of a conductor means.

5. An electrical connector device as specified in claim 1 further characterized in that said electrical shunt means is movable into non-contacting electrical communication with said electrically conducting portion of said second contact means responsive to pressurized gas evolving from said free end portion of said second contact means.

6. An electrical connector device as specified in claim 5 further including a variable volume chamber means formed within said housing means, a portion of said chamber being formed by a portion of said first segment of said electrical shunt means, said chamber providing for a pressure build up of gas evolving from said free end portion of said second contact means.

7. An electrical bushing comprising: an elongated insulating housing structure having a longitudinally extending passageway therein; a fixed electrical structure including stationary female contact means carried within said passageway; electrical shunt means axially reciprocable within said passageway and in electrical communication with said fixed structure in all relative positions thereof, said shunt means including a piston portion at one end thereof which is cooperable with an enlarged intermediate portion of said passageway to define a variable volume chamber therebetween and having an electrically conductive portion at the other end thereof which is positionable adjacent the opening of said female contact means and is movable to a location axially outwardly spaced from said opening; and means for communicating gas between the interior of said contact means and said chamber.

8. A bushing as specified in claim 7 additionally including biasing means disposed within said housing structure and in communication with said shunt means to bias said conductive portion toward said opening.

9. A method of closing an energized electrical circuit between an electrical bushing and an electrical contact matable therewith in which an electrical arc results in the creation of pressurized gas within said bushing during the insertion of said electrical contact, the improvement comprising: discontinuing such gas creation substantially immediately after the creation thereof; and thereafter continuing the insertion of said contact to extinguish said arc and to provide electrical-mechanical engagement between said bushing and said contact.

10. The method as specified in claim 9 wherein during said discontinuing current passing between said contact and said bushing is through a temporary electrical path in which electrical arcing occurs.

11. The method as specified in claim 10 wherein said arcing passes through an air gap.

12. The method as specified in claim 9 wherein said pressurized gas is created by said electrical arc passing over a gas producing material.

13. An electrical termination comprising: an insulating housing structure; an elongated fixed electrically conductive structure immovably carried within said housing; said fixed structure having a female electrical contact portion having a free end accessible from the exterior of said housing structure through a bore, which contact portion is adapted to electrically and mechanically engage a mating male electrical contact; a movable structure within said housing longitudinally movable with respect to said fixed structure; said movable structure having an electrically conductive portion positioned axially outwardly with respect to said female contact portion in electrical conductive relationship with said fixed structure throughout the extent of the relative longitudinal movement therebetween; and said movable structure having at least one surface area thereon in gaseous communication with said bore and responsive to a gas generated within said bore to move said movable structure outwardly in response to such gas attaining at least a given pressure.

14. An electrical termination as specified in claim 13 wherein: said movable structure defines said bore.

15. An electrical termination as specified in claim 13 wherein: said housing structure comprises an elastomeric member surrounding said fixed structure and a nose bushing secured to said outer end portion of said fixed structure.

16. An electrical termination as specified in claim 13 wherein: said movable structure comprises a tubular conductive member slidably carried by said fixed structure, and said electrically conductive portion is an arcing ring carried by said tubular member at an outer end portion thereof.

17. An electrical termination as specified in claim 16 wherein: said movable structure additionally comprises a tubular element of arc-responsive gas generating material positioned outwardly of said arcing ring.

18. An electrical termination as specified in claim 16 wherein: said at least one surface area is an inward surface of said arcing ring.

19. An electrical termination as specified in claim 13 additionally comprising: biasing means between said fixed structure and said movable structure for biasing said movable structure inwardly.

20. An electrical termination as specified in claim 19 wherein: said biasing means comprises a compression spring extending between a shoulder on said fixed structure and at least one flange on said movable structure.

21. An electrical termination as specified in claim 13 wherein: said fixed electrical structure comprises an annular conductive guide cylinder and said electrical contact portion, the end of said contact portion opposite said free end being secured to said guide cylinder.

* * * * *